US008958732B2

(12) United States Patent
Saiki

(10) Patent No.: US 8,958,732 B2
(45) Date of Patent: Feb. 17, 2015

(54) FIXING DEVICE AND IMAGE FORMING APPARATUS

(75) Inventor: Mikio Saiki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 141 days.

(21) Appl. No.: 13/605,309

(22) Filed: Sep. 6, 2012

(65) Prior Publication Data

US 2013/0236222 A1 Sep. 12, 2013

(30) Foreign Application Priority Data

Mar. 8, 2012 (JP) ..... 2012-051496

(51) Int. Cl.
*G03G 15/20* (2006.01)

(52) U.S. Cl.
USPC ..... 399/329

(58) Field of Classification Search
CPC ..... G03G 15/2064; G03G 2221/1639; G03G 2215/2016
USPC ..... 399/328, 329
See application file for complete search history.

(56) References Cited

U.S. PATENT DOCUMENTS

2009/0180805 A1 7/2009 Nakura et al.

FOREIGN PATENT DOCUMENTS

| | | | |
|---|---|---|---|
| JP | 11116089 A | * | 4/1999 |
| JP | 2006-225130 A | | 8/2006 |
| JP | 2007-10742 A | | 1/2007 |
| JP | 2009-145765 A | | 7/2009 |

OTHER PUBLICATIONS

Kurotaka (JP 11-116089 A), Apr. 1999, JPO Computer Translation.*

* cited by examiner

*Primary Examiner* — Erika J Villaluna
(74) *Attorney, Agent, or Firm* — Sughrue Mion, PLLC

(57) ABSTRACT

A fixing device includes a plurality of belt support members including a first roller, an endless belt, a heating structure, a first support that has two bearings and an urging part and supports the first roller via the urging part and the two bearings, a second support that supports at least one another belt support member excluding the first roller, the second support rotatably supporting the first roller, an angle changing mechanism that changes an angle of the first support with respect to the second support to correct eccentricity in a width direction of the endless belt, and a second roller that rotates while being pressed against an outer surface of the endless belt, the second roller sandwiching a medium carrying an unfixed toner image between the second roller and the endless belt, the second roller fixing the toner image to the medium in cooperation with the endless belt.

11 Claims, 4 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-051496 filed Mar. 8, 2012.

BACKGROUND (i) Technical Field

The present invention relates to a fixing device and an image forming apparatus.

(ii) Related Art

In the related art, there are fixing devices in which a toner image is fixed to a medium such as paper by cooperation of an endless belt that is heated, and a pressure roller that is pressed against the outer surface of the endless belt.

SUMMARY

According to an aspect of the invention, there is provided a fixing device including: a plurality of belt support members including a first roller, the first roller having a rotating shaft; an endless belt that circulates while being supported from inside by the belt support members; a heating structure that heats the endless belt; a first support having two bearings that support opposite ends of the rotating shaft of the first roller, and an urging part that urges each of the two bearings in a direction that applies tension to the endless belt, the first support supporting the first roller via the urging part and the two bearings; a second support that supports at least one another belt support member of the belt support members excluding the first roller, the first support rotatably supporting the first roller; an angle changing mechanism that changes an angle of the first support with respect to the second support to correct eccentricity in a width direction of the endless belt; and a second roller that rotates while being pressed against an outer surface of the endless belt, the second roller sandwiching a medium carrying a toner image that is unfixed between the second roller and the endless belt, the second roller fixing the toner image to the medium in cooperation with the endless belt.

BRIEF DESCRIPTION OF THE DRAWINGS

Exemplary embodiment of the present invention will be described in detail based on the following figures, wherein.

DETAILED DESCRIPTION

Hereinafter, an exemplary embodiment will be described with reference to the drawings.

Hereinafter, an exemplary embodiment of the invention will be described.

Figure 1:
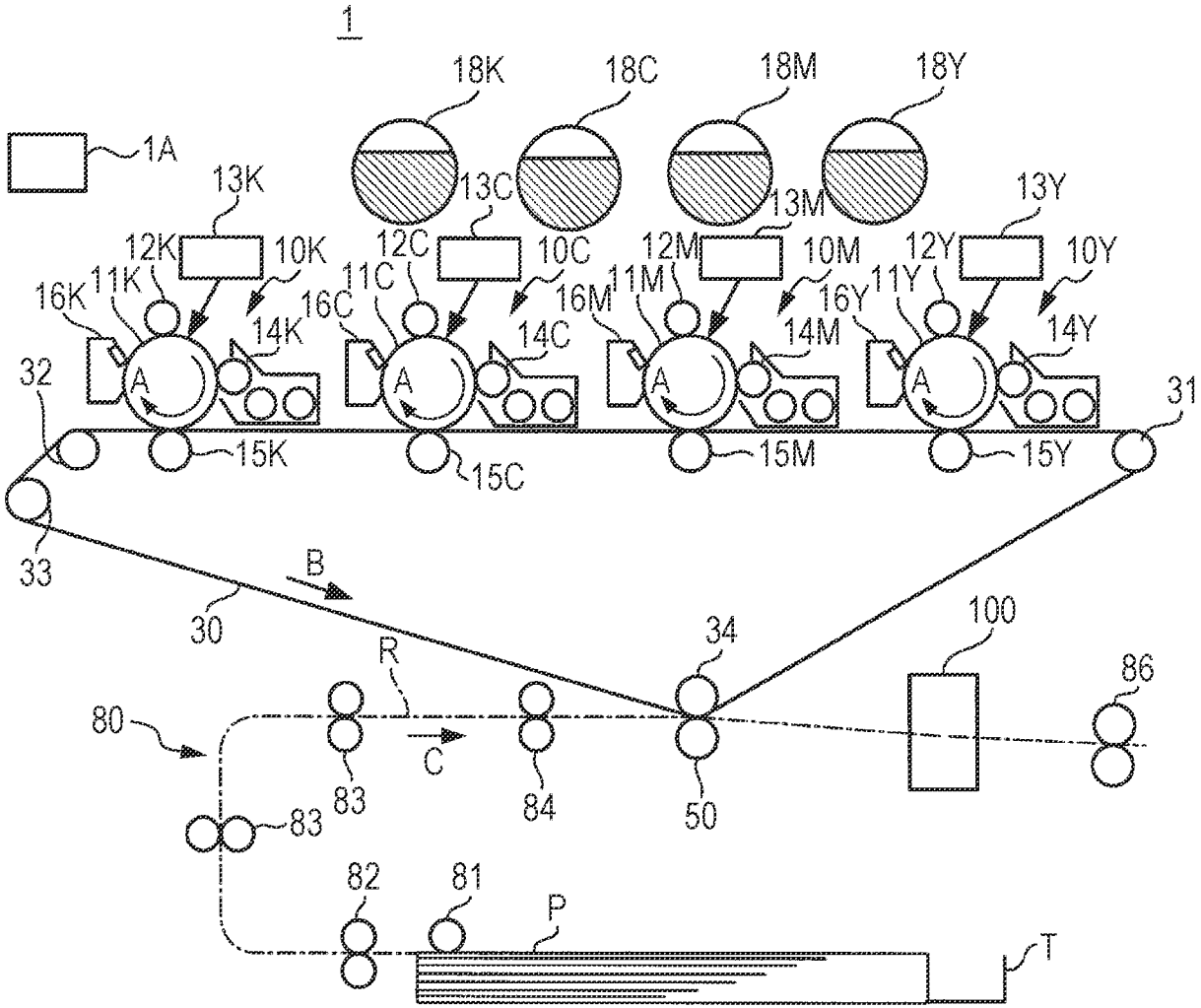
FIG. 1 illustrates the configuration of an image forming apparatus according to an exemplary embodiment of the invention.

FIG. 1 illustrates the configuration of an image forming apparatus according to an exemplary embodiment of the invention.

An image forming apparatus 1 illustrated in FIG. 1 is a tandem color printer in which image forming parts 10Y, 10M, 10C, 10K are arranged in a parallel fashion for the colors yellow (Y), magenta (M), cyan (C) and black (K). In addition to monochrome image printing, the image forming apparatus 1 also executes printing of full-color images formed by toner images of four colors. Toner cartridges 18Y, 18M, 18C, 18K contain toner for each of the colors YMCK. For example, toner has an average particle size of not less than 2 μm and not more than 7 μm, and a circle equivalent diameter of not less than 0.95 and not more than 1.0. Also, the toner cartridges 18Y, 18M, 18C, 18K also contain a lubricant as an external additive for the toner.

Since the four image forming parts 10Y, 10M, 10C, 10K have substantially the same configuration, the image forming part 10Y corresponding to yellow will be described below as a representative example. The image forming part 10Y includes a photoconductor 11Y, a charging unit 12Y, an exposure unit 13, a developing unit 14Y, and a first transfer unit 15Y. Also, the image forming part 10Y is provided with a photoconductor cleaner 16Y that cleans the photoconductor 11Y.

The photoconductor 11Y is a drum having a photoconductor layer provided on the surface of a base that is in the form of a cylinder. The photoconductor 11Y carries an image formed on its surface, and rotates in the direction of arrow A around the axis of the cylinder. The charging unit 12Y, the exposure unit 13Y, the developing unit 14Y, the first transfer unit 15Y, and the photoconductor cleaner 16Y are arranged in this order in the direction of arrow A around the photoconductor 11Y.

The charging unit 12Y electrically charges the surface of the photoconductor 11Y. The charging unit 12Y is a charging roller that contacts the surface of the photoconductor 11Y. The charging unit 12Y is applied with a voltage of the same polarity as the polarity of toner in the developing unit 14Y. The charging unit 12Y electrically charges the surface of the photoconductor 11Y that is in contact with the charging unit 12Y. The exposure unit 13Y exposes the surface of the photoconductor 11Y to light by irradiating the photoconductor 11Y with exposure light. The exposure unit 13Y emits laser light corresponding to an image signal supplied from the outside of the image forming apparatus 1, and scans the surface of the photoconductor 11Y with the laser light.

The developing unit 14Y develops an image on the surface of the photoconductor 11Y by using a developer. Toner is supplied to the developing unit 14Y from the toner cartridge 18Y. The developing unit 14Y agitates the developer that is a mixture of magnetic carrier and toner to electrically charge the toner and the magnetic carrier, and develops an image on the surface of the photoconductor 11 with the electrically charged toner. The first transfer unit 15Y is a roller that faces the photoconductor 11Y across an intermediate transfer belt 30. As voltage is applied to the photoconductor 11Y, the first transfer unit 15Y transfers the toner image on the photoconductor 11Y to the intermediate transfer belt 30.

The photoconductor cleaner 16Y removes toner (residual toner) remaining in the portion of the surface of the photoconductor 11Y which has undergone transfer by the first transfer unit 15Y, thereby cleaning the surface of the photoconductor 11Y.

The image forming apparatus 1 also includes the intermediate transfer belt 30, a fixing device 100, a sheet transport part 80, and a controller 1A. The intermediate transfer belt 30 is an endless belt that is looped over belt support rollers 31 to 34. The intermediate transfer belt 30 circulates in the direction of arrow B via the image forming parts 10Y, 10M, 10C, 10K and a second transfer unit 50. Toner images of various colors are transferred to the intermediate transfer belt 30 from the image forming parts 10Y, 10M, 10C, 10K. The intermediate transfer belt 30 moves while carrying these toner images of various colors.

The second transfer unit 50 is a roller that rotates while sandwiching the intermediate transfer belt 30 and paper P between the second transfer unit 50 and a backup roller 34 that is one of the belt support rollers 31 to 34. When applied with a voltage of a polarity opposite to the polarity of the charge on the toner, the second transfer unit 50 transfers a toner image on the intermediate transfer belt 30 to the paper P.

A combination of the image forming parts 10Y, 10M, 10C, 10K, the intermediate transfer belt 30, and the second transfer unit 50 corresponds to an example of an image forming part according to an exemplary embodiment of the invention.

The fixing device 100 is a device that fixes a toner image onto the paper P. The fixing device 100 corresponds to an example of a fixing device according to an exemplary embodiment of the invention. Further, the fixing device also corresponds to an example of a fixing part included in the image forming apparatus according to an exemplary embodiment of the invention. The fixing device 100 will be described later in detail.

The sheet transport part 80 includes a pick-up roller 81 that picks up the paper P contained in a paper container T, a separation roller 82 that separates a sheet of the picked up paper P, and a transport roller 83 that transports the paper P. Further, the sheet transport part 80 also includes a registration roller 84 that transports the paper P to the second transfer unit 50, and a discharge roller 86 that discharges the paper P to the outside. The sheet transport part 80 transports the paper P along a sheet transport path R that passes through the second transfer unit 50 and the fixing device 100.

The basic operation of the image forming apparatus 1 illustrated in FIG. 1 will be described below. In the image forming part 10Y corresponding to yellow, the photoconductor 11Y rotates in the direction of arrow A, and the surface of the photoconductor 11Y is electrically charged by the charging unit 12Y. The exposure unit 13Y irradiates the surface of the photoconductor 11Y with exposure light that is based on an image signal corresponding to yellow among image signals supplied from the outside, thereby forming an electrostatic latent image on the surface of the photoconductor 11Y. The developing unit 14Y receives supply of yellow toner from the toner cartridge 18Y, and develops the electrostatic latent image on the photoconductor 11Y with the toner, thereby forming a toner image. The photoconductor 11Y rotates while carrying the yellow toner image formed on its surface. The toner image formed on the surface of the photoconductor 11Y is transferred to the intermediate transfer belt 30 by the first transfer unit 15Y. After the transfer, residual toner remaining on the photoconductor 11Y is removed by the photoconductor cleaner 16Y.

The intermediate transfer belt 30 circulates in the direction of arrow B. Like the image forming part 10Y, the image forming parts 10M, 10C, 10K corresponding to colors other than yellow form toner images of the corresponding colors. Then, the toner images of these colors are sequentially transferred to the intermediate transfer belt 30 by being overlaid on top of the toner image that has been transferred in the image forming part 10Y.

The paper P is picked up by the pick-up roller 81 from the paper container T. The paper P is transported by the transport roller 83 and the registration roller 84 along the paper transport path R in the direction of arrow C that points toward the second transfer unit 50. The registration roller 84 feeds the paper P to the second transfer unit 50 on the basis of the timing at which a toner image is transferred onto the intermediate transfer belt 30. The second transfer unit 50 transfers a toner image on the intermediate transfer belt 30 to the paper P. The paper P with the transferred toner image is transported to the fixing device 100, and the toner image transferred on the paper P is fixed by the fixing device 100. In this way, an image is formed on the paper P. The paper P with the formed image is discharged to the outside of the image forming apparatus 1 by the discharge roller 86.

Next, the fixing device 100 will be described below.

Figure 2:
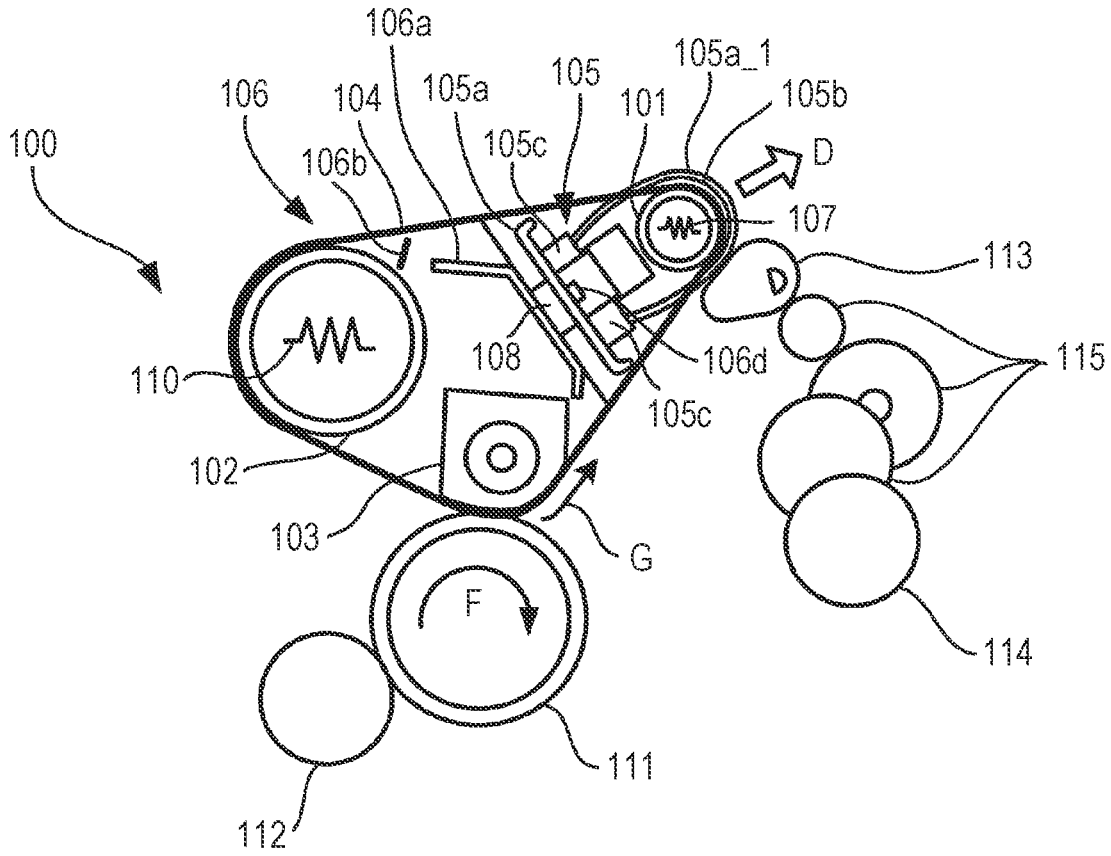
FIG. 2 schematically illustrates the internal structure of a fixing device.
Figure 3:
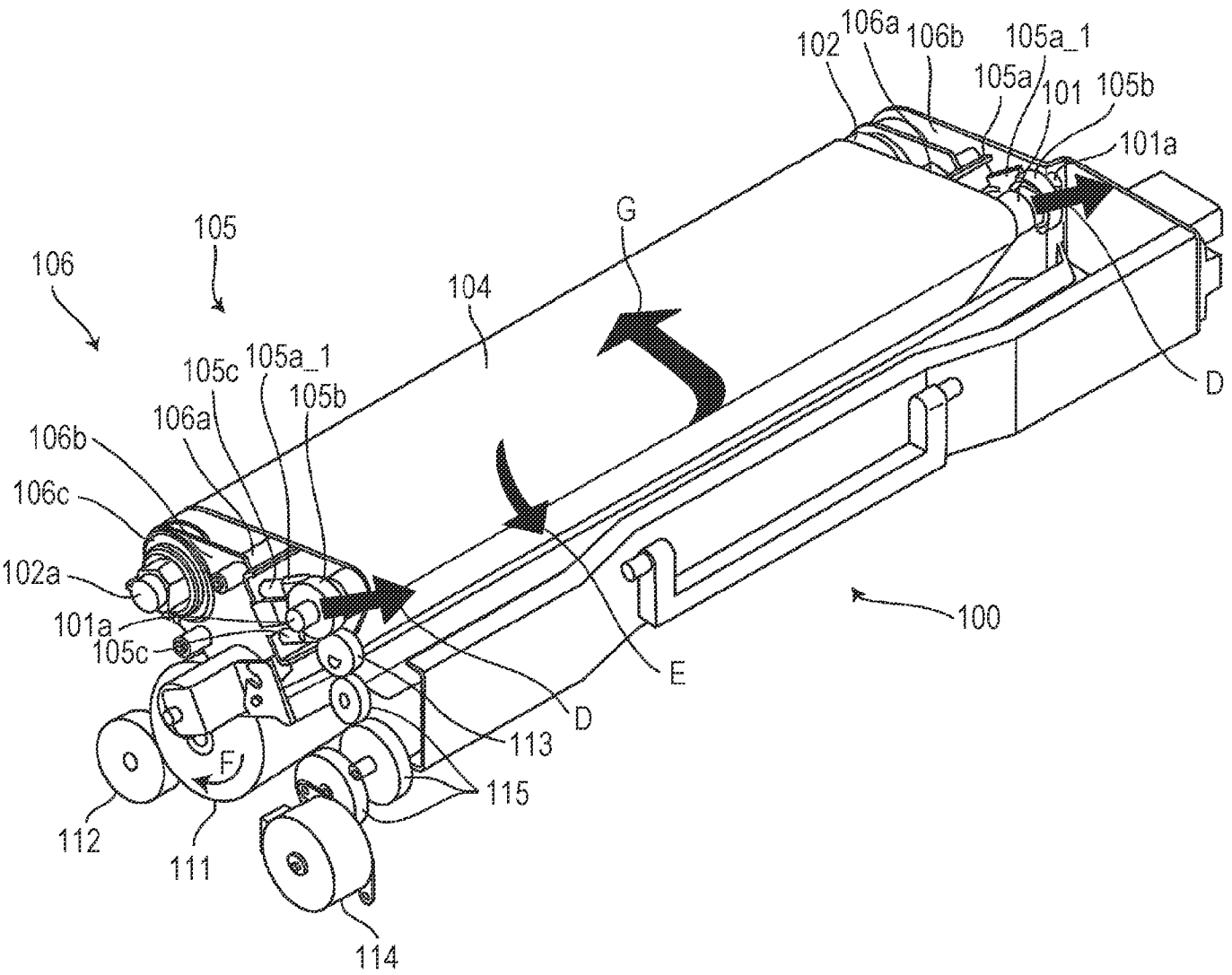
FIG. 3 is a perspective view of the fixing device schematically illustrated in FIG. 2.

FIG. 2 schematically illustrates the internal structure of the fixing device. FIG. 3 is a perspective view of the fixing device schematically illustrated in FIG. 2.

The fixing device 100 includes a first roller 101, a second roller 102, a stationary pad 103, and an endless belt 104 that is supported from inside by these components. The first roller 101, the second roller 102, and the stationary pad 103 correspond to an example of a plurality of belt support members according to an exemplary embodiment of the invention. Also, the first roller 101 corresponds to an example of a first roller according to an exemplary embodiment of the invention, and the second roller 102 and the stationary pad 103 each corresponds to an example of at least one another belt support member according to an exemplary embodiment of the invention. Also, the endless belt 104 corresponds to an example of an endless belt according to an exemplary embodiment of the invention.

Further, the fixing device 100 includes a first support 105 that supports the first roller 101, and a second support 106 that supports the second roller 102 and the stationary pad 103. The first support 105 corresponds to an example of a first support according to an exemplary embodiment of the invention, and the second support 106 corresponds to an example of a second support according to an exemplary embodiment of the invention.

The first support 105 has a flat plate part 105*a* and two bearings 105*b*. The flat plate part 105*a* is arranged inside the endless belt 104. The two bearings 105*b* rotatably support the opposite ends of a rotating shaft 101*a* of the first roller 101. Also, the flat plate part 105*a* has a bearing support part 105*a*1 provided in a standing position. Each of the bearings 105*b* is supported on the bearing support part 105*a*1 so as to be slidable with respect to a direction substantially orthogonal to the flat plate part 105*a*. Further, two compression springs 105*c* are arranged in a compressed state between the flat plate part 105*a* and each of the bearings 105*b*. Each of the bearings 105*b* is urged by the two compression springs 105*c* in a direction substantially orthogonal to the flat plate part 105*a*, that is, in the direction of arrow D that applies tension to the endless belt 104. Each of the bearings 105*b* corresponds to an example of a bearing according to an exemplary embodiment of the invention. Also, the two compression springs 105*c* correspond to an example of an urging part according to an exemplary embodiment of the invention. Also, the two compression springs 105*c* also correspond to an example of a plurality of urging springs according to an exemplary embodiment of the invention.

In this exemplary embodiment, urging of each one of the bearings 105*b* is done by the resultant of the urging forces from the two compression springs 105*c*. Thus, in this exemplary embodiment, small compression springs with limited urging force are adopted as the compression springs 105*c* to thereby achieve miniaturization of the fixing device 100 as a whole.

The first roller 101 is supported on the first support 105 via the two compression springs 105*c* and the two bearings 105*b*. Also, a heater 107 for heating the endless belt 104 is built in the inside of the first roller 101. The heater 107 inside the first roller 101 corresponds to an example of a heater according to an exemplary embodiment of the invention.

The second support 106 has a flat plate part 106*a* and two side plate parts 106*b*, inside the endless belt 104. The flat plate part 106*a* is arranged so as to face the flat plate part 105*a* of the first support 105. The two side plate parts 106*b* sandwich and thus secure the flat plate part 106 in place from opposite end sides. Two bearings 106*c* are each secured to each of the side plate parts 106*b*. The bearings 106*c* rotatably support the opposite ends of a rotating shaft 102*a* of the second roller 102. Also, the stationary pad 103 is arranged between the two side plate parts 106*b*. The opposite ends of the stationary pad 103 are secured to the side plate parts 106*b*.

Also, the second support 106 rotatably supports the first support 105 in the manner as described below.

Figure 4:
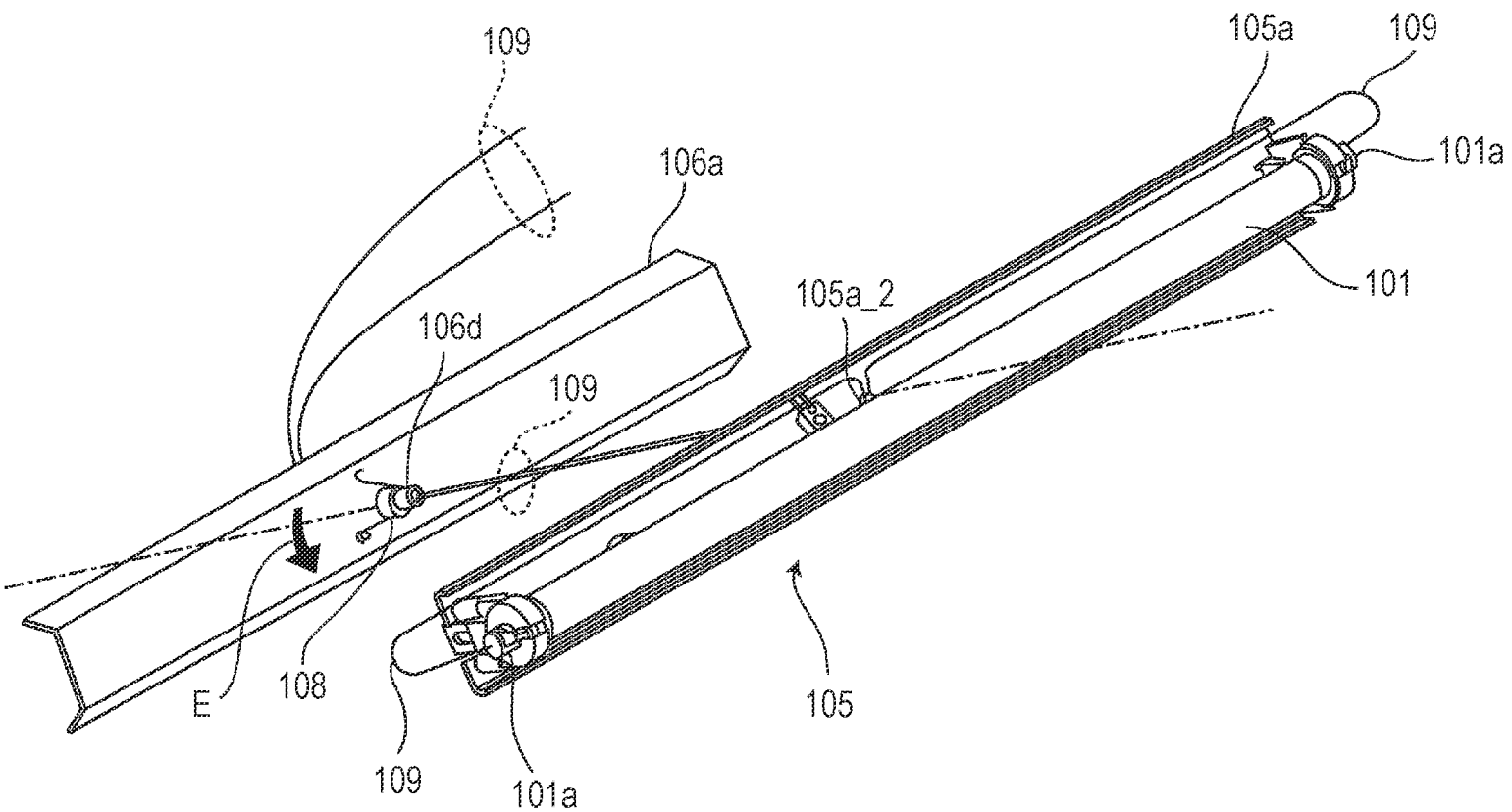
FIG. 4 is an exploded perspective view illustrating in detail a structure by which a second support rotatably supports a first support.

FIG. 4 is an exploded perspective view illustrating in detail a structure by which the second support rotatably supports the first support.

FIG. 4 depicts the first support 105 supporting the first roller 101, and the flat plate part 106*a* of the second support 106.

A hollow shaft rod 106*d* protrudes toward the flat plate part 105*a* of the first support 105 from the central part of the flat plate part 106*a* of the second support 106. A through-hole 105*a*2 is provided at the center of the flat plate part 105*a* of the first support 105. The shaft rod 106*d* is inserted into the through-hole 105*a*2 in the flat plate part 105*a* of the first support 105. The shaft rod 106*d* corresponds to an example of a shaft rod according to an exemplary embodiment of the invention.

Further, a torsion spring 108 is arranged between the flat plate part 106*a* of the second support 106 and the flat plate part 105*a* of the first support 105, in such a way that the torsion spring 108 is wound on the shaft rod 106*d*. One end of the torsion spring 108*a* is secured to the flat plate part 106*a* of the second support 106, and the other end is secured to the flat plate part 105*a* of the first support 105. The torsion spring 108 urges the first support 105 in a direction that causes the first support 105 to tilt in the direction of arrow E illustrated also in FIG. 3 with respect to the second support 106. The torsion spring 108 corresponds to an example of a second urging part according to an exemplary embodiment of the invention.

As described above, the heater 107 for heating the endless belt 104 is provided inside the first roller 101. An electric wire 109 is wired to the heater 107 from the back side of the flat plate part 106*a* of the second support 106 opposite to the first support 105, through the wiring path described below. The electric wire 109 supplies electrical power to the heater 107 from a power source (not illustrated). The electric wire 109 is led out from the distal end of the shaft rod 106*d* inserted in the through-hole 105*a*_2, via the inside of the hollow of the shaft rod 106*d* on the flat plate part 106*a* of the second support 106. Thereafter, the electric wire 109 is routed along the flat plate part 105*a* of the first support 105, reaches the inside of the first roller 101 from either end of the rotating shaft 101*a* of the first roller 101, and is connected to the heater 107. The electric wire 109 corresponds to an example of an electric wire according to an exemplary embodiment of the invention.

In this exemplary embodiment, the first support 105 is rotatably supported by the shaft rod 106*d*, and is tilted about the shaft rod 106*d* by a mechanism described later.

In this exemplary embodiment, the electric wire 109 connected to the heater 107 inside the first roller 101 supported on the first support 105 passes through the inside of the hollow of the shaft rod 106*d* that does not move with movement of the first support 105. Therefore, situations such as breaking of the electric wire 109 due to rubbing when the first support 105 moves are avoided.

The description of the structure by which the second support rotatably supports the first support given above with reference to FIG. 4 is now complete. Returning to FIG. 2 and FIG. 3, the description of the fixing device 100 is continued.

The second roller 102 is supported on the second support 105 via the two bearings 106*c*. A heater 110 for heating the endless belt 104 is also built in the inside of the second roller 102. Electrical power is also supplied to the heater 110 inside the second roller 102 via an electrical wire (not illustrated).

The fixing device 100 also includes a pressure roller 111. The pressure roller 111 is pressed against the outer surface of the endless belt 104, while sandwiching the endless belt 104 between the pressure roller 111 and the stationary pad 103. The pressure roller 111 corresponds to an example of a second roller according to an exemplary embodiment of the invention.

The pressure roller 111 rotates in the direction of arrow F as a rotational drive force is applied to the pressure roller 111 from a motor (not illustrated) via a pressure roller driving gear 112. When the pressure roller 111 rotates, the endless belt 104 circulates in the direction of arrow G by following this rotation. Also, the each of the first roller 101 and the second roller 102 rotates by following this circulation.

A sliding sheet (not illustrated) is stuck on the outer surface on the endless belt 104 side of the stationary pad 103, which is a component that does not move and is secured to the side plate parts 106*b* of the second support 106. As the endless belt 104 circulates, the inner surface of the endless belt 104 slides on this sliding sheet.

In the fixing device 100, the paper P carrying an unfixed toner image is transported to the space between the pressure roller 111, and the endless belt 104 that circulates while being heated by the heater 107 inside the first roller 101 and the heater 110 inside the second roller 102. Then, the pressure from the pressure roller 111 and the heat from the endless belt 104 fix the toner image to the paper P.

In the fixing device 100, eccentricity in the width direction of the endless belt 104 being circulated is corrected by changing the angle of the first support 105 with respect to the second support 106. This angle change is effected by the following mechanism.

As described above, the first support 105 is urged in the direction of arrow E by the torsion spring 108. The fixing device 100 is provided with a cam 113. When the cam 113 rotates, the cam 113 presses the bearing support part 105*a*_1 of the first support 105 which is located on the foreground side in FIG. 3, in such a way that causes the first support 105 to tilt in a direction opposite to the direction of arrow E. Further, the fixing device 100 is provided with a motor 114 for rotating the cam, and a gear group 115 that transmits a rotational drive force from the motor 114 to the cam 113. The cam 113 corresponds to an example of a cam according to an exemplary embodiment of the invention. A combination of the motor 114 and the gear group 115 corresponds to an example of a cam driving part according to an exemplary embodiment of the invention. A combination of the cam 113, the motor 114, and the gear group 115 corresponds to an example of an angle changing mechanism according to an exemplary embodiment of the invention.

As a mechanism for changing the angle of the first support 105 with respect to the second support 106, for example, a structure is conceivable in which, unlike this exemplary embodiment, a mechanism for tilting the first support 105 in the direction of arrow E and a mechanism for tilting the first support 105 in a direction opposite to the direction of arrow E are provided and these mechanisms are moved. As opposed to this structure, in this exemplary embodiment, only one set of the cam 113, the motor 114, and the gear group 115 provided at one end of the first support 105 suffices as the mechanism for tilting the first support 105. By adopting such a mechanism, this exemplary embodiment achieves miniaturization of the fixing device 100 in comparison to the structure in which two mechanisms are provided as mentioned above.

In the fixing device 100, when an eccentricity sensor (not illustrated) detects eccentricity in the width direction of the endless belt 104, upon instruction from the controller 1A illustrated in FIG. 1, the motor 114 for rotating the cam rotates the cam 113 via the gear group 115 in a direction that corrects the detected eccentricity. This rotation of the cam 113 is executed whenever necessary while eccentricity is detected.

As a structure for applying tension to the endless belt 104, a structure is conceivable in which, unlike this exemplary embodiment, the first support 105 is urged by a compression spring in a direction that moves the first support 105 away from the second support 106. In this structure, the first support 105 and the second support 106 are connected to each other by the compression spring. For this reason, in this structure, when the first support 105 is tilted in order to correct eccentricity of the endless belt 104, the compression spring that applies tension to the endless belt 104 expands or contracts. This expansion or contraction of the compression spring causes variations in the tension applied to the endless belt 104. Such variations in tension can cause the endless belt 104 to become eccentric in some cases. As described above, according to the structure in which the first support 105 and the second support 106 are connected to each other by a compression spring, the very operation of tilting the first support 105 in order to correct eccentricity of the endless belt 104 may contrarily result in eccentricity, and proper control in this regard is difficult.

In this exemplary embodiment, the compression springs 105*c* that apply tension to the endless belt 104 are not connected to the second support 106, and upon tilting the first support 105, the compression springs 105*c* undergo relatively small expansion or contraction in comparison to the structure in which the first support 105 and the second support 106 are connected to each other by a compression spring. Hence, in this exemplary embodiment, eccentricity of the endless belt is corrected with high accuracy in comparison to such a structure.

Also, in this exemplary embodiment, the first support 105 is rotatably supported in the central part by the shaft rod 106*d* mentioned above. As a method of rotatably supporting and tilting the first support 105, unlike this exemplary embodiment, another conceivable method is to tilt the first support 105 by rotatably supporting the first support 105 at one end and moving the first support 105 at the other end. As opposed to this method, according to this exemplary embodiment in which the first support is rotatably supported in the central part, the amount by which one end of the first support 105 needs to be moved by the cam 113 mentioned above in order to tilt the first support 105 by a given angle is only about half of what is required in this method.

This exemplary embodiment illustrates the fixing device 100 in which the endless belt is looped over the two rollers and the single stationary pad. However, the fixing device may be a fixing device in which, for example, the endless belt may be looped over only two or more rollers, or the endless belt may be looped over two or more rollers and one or more stationary pads.

Also, this exemplary embodiment illustrates the fixing device 100 in which the endless belt is heated by the heaters each provided inside each one of the two rollers that support this endless belt from inside. However, the fixing device may be a fixing device in which, for example, a heater is provided only inside one of the rollers that support the endless belt from inside, and the endless belt is heated by the heater. Also, the fixing device may be a fixing device in which, for example, a heater is provided inside the stationary pad that supports the endless belt from inside, and the endless belt is heated by the heater. Alternatively, the fixing device may be a fixing device in which, for example, a heater is provided inside the roller that is pressed against the outer surface of the endless belt, and the endless belt is heated by the heater from the outer surface.

Also, this exemplary embodiment illustrates the fixing device 100 in which the shaft rod that rotatably supports the first support protrudes from the second support and is inserted in the through-hole in the first support. However, the fixing device may be a fixing device in which, for example, the shaft rod protrudes from the first support toward the second support and is inserted in a through-hole provided in the second support.

Also, this exemplary embodiment illustrates a tandem color printer as an example of the image forming apparatus according to an exemplary embodiment of the invention. However, the image forming apparatus according to an exemplary embodiment of the invention may be a so-called rotary color printer in which plural developing units are arranged around the rotation axis, or may be a monochrome printer. Also, the image forming apparatus according to an exemplary embodiment of the invention is not limited to a printer but may be a copier, a facsimile, or the like.

The foregoing description of the exemplary embodiment of the invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a plurality of belt support members including a first roller, the first roller having a rotating shaft;

an endless belt that circulates while being supported from inside by the belt support members;

a heating structure that heats the endless belt;

a first support having:

two bearings that support opposite ends of the rotating shaft of the first roller; and an urging part that urges each of the two bearings in a direction that applies tension to the endless belt, the first support supporting the first roller via the urging part and the two bearings;

a second support that supports at least one other belt support member of the belt support members excluding the first roller, the first support rotatably supporting the first roller;

an angle changing mechanism that changes an angle of the first support with respect to the second support to correct eccentricity in a width direction of the endless belt; and a second roller that rotates while being pressed against an outer surface of the endless belt, the second roller sandwiching a medium carrying a toner image that is unfixed between the second roller and the endless belt, the second roller fixing the toner image to the medium in cooperation with the endless belt, wherein the second support rotatably supports the first support.

2. The fixing device according to claim 1, wherein the urging part includes a plurality of urging springs, and urges each of the two bearings by the urging springs.

3. The fixing device according to claim 2, wherein the angle changing mechanism comprises:

a second urging part that urges the first support in a direction that causes the angle of the first support with respect to the second support to tilt in a first direction;

a cam that is rotatably supported on the second support, the cam adjusting the angle of the first support with respect to the second support by rotating to press the first support in a direction that causes the first support to tilt in a direction opposite to the first direction; and a cam driving part that rotates the cam to change the angle of the first support with respect to the second support so as to correct the eccentricity in the width direction of the endless belt.

4. The fixing device according to claim 2, wherein:

one of the first support and the second support has a shaft rod having a hollow, the shaft rod rotatably supporting the first support on the second support; and the heating structure comprises:

a heater that is provided inside the first roller: and an electrical wire that supplies electrical power to the heater, the electrical wire being connected to the heater via the hollow of the shaft rod.

5. The fixing device according to claim 1, wherein the angle changing mechanism comprises:

a second urging part that urges the first support in a direction that causes the angle of the first support with respect to the second support to tilt in a first direction, a cam that is rotatably supported on the first support, the cam adjusting the angle of the first support with respect to the second support by rotating to press the first support in a direction that causes the first support to tilt in a direction opposite to the first direction, and a cam driving part that rotates the cam to change the angle of the first support with respect to the second support so as to correct the eccentricity in the width direction of the endless belt.

6. The fixing device according to claim 5, wherein:

one of the first support and the second support has a shaft rod having a hollow, the shaft rod rotatably supporting the first support on the second support; and the heating structure comprises:

a heater that is provided inside the first roller; and an electrical wire that supplies electrical power to the heater, the electrical wire being connected to the heater via the hollow of the shaft rod.

7. The fixing device according to claim 1, wherein:

one of the first support and the second support has a shaft rod having a hollow, the shaft rod rotatably supporting the first support on the second support; and the heating structure comprises:

a heater that is provided inside the first roller; and an electrical wire that supplies electrical power to the heater, the electrical wire being connected to the heater via the hollow of the shaft rod.

8. An image forming apparatus comprising:

an imaging forming part that forms an electrostatic latent image, develops the electrostatic latent image with toner to form a toner image, and delivers the toner image to a medium; and a fixing part that fixes the toner image that is unfixed and has been delivered to the medium onto the medium, the fixing part including:

a plurality of belt support members including a first roller, the first roller having a rotating shaft;

an endless belt that circulates while being supported from inside by the belt support members a heating structure that heats the endless belt;

a first support having;

two bearings that support opposite ends of the rotating shaft of the first roller; and an urging part that urges each of the two bearings in a direction that applies tension to the endless belt;

the first support supporting the first roller via the urging part and the two bearings,;

a second support that supports at least one other belt support member of the belt support members excluding the first roller, the first support rotatably supporting the first roller;

an angle changing mechanism that changes an angle of the first support with respect to the second support to correct eccentricity in a width direction of the endless belt; and a second roller that rotates while being pressed against an outer surface of the endless belt, the second roller sandwiching a medium carrying a toner image that is unfixed between the second roller and the endless belt, the second roller fixing the toner image to the medium in cooperation with the endless belt, wherein the second support rotatably supports the first support.

9. A fixing device comprising:

a plurality of belt support members including a first roller, the first roller having a rotating shaft;

an endless belt that circulates while being supported from inside by the belt support members;

a heating structure that heats the endless belt;

a first support having:

two bearings that support opposite ends of the rotating shaft of the first roller; and an urging part that urges each of the two bearings in a direction that applies tension to the endless belt, the first support supporting the first roller via the urging part and the two bearings;

a second support that supports at least one other belt support member of the belt support members excluding the first roller, the first support rotatably supporting the first roller;

an angle changing mechanism that changes an angle of the first support with respect to the second support to correct eccentricity in a width direction of the endless belt; and a second roller that rotates while being pressed against an outer surface of the endless belt, the second roller sandwiching a medium carrying a toner image that is unfixed between the second roller and the endless belt, the second roller fixing the toner image to the medium in cooperation with the endless belt, wherein:

one of the first support and the second support has a shaft rod having a hollow, the shaft rod rotatably supporting the first support on the second support; and the heating structure comprises:

a heater that is provided inside the first roller; and an electrical wire that supplies electrical power to the heater, the electrical wire being connected to the heater via the hollow of the shaft rod.

10. An image forming apparatus comprising:

an imaging forming part that forms an electrostatic latent image, develops the electrostatic latent image with toner to form a toner image, and delivers the toner image to a medium; and a fixing part that fixes the toner image that is unfixed and has been delivered to the medium onto the medium, the fixing part including:

a plurality of belt support members including a first roller, the first roller having a rotating shaft;

an endless belt that circulates while being supported from inside by the belt support members;

a heating structure that heats the endless belt;

a first support having:

two bearings that support opposite ends of the rotating shaft of the first roller; and an urging part that urges each of the two bearings in a direction that applies tension to the endless belt;

the first support supporting the first roller via the urging part and the two bearings;

a second support that supports at least one other belt support member of the belt support members excluding the first roller, the first support rotatably supporting the first roller;

an angle changing mechanism that changes an angle of the first support with respect to the second support to correct eccentricity in a width direction of the endless belt; and a second roller that rotates while being pressed against an outer surface of the endless belt, the second roller sandwiching a medium carrying a toner image that is unfixed between the second roller and the endless belt, the second roller fixing the toner image to the medium in cooperation with the endless belt, wherein:

one of the first support and the second support has a shaft rod having a hollow, the shaft rod rotatably supporting the first support on the second support; and the heating structure comprises:

a heater that is provided inside the first roller; and an electrical wire that supplies electrical power to the heater, the electrical wire being connected to the heater via the hollow of the shaft rod.

11. The fixing device according to claim 1, wherein the second support rotatably supports the first support at a central part of the first support.

* * * * *